US006662976B2

(12) United States Patent
Jensen et al.

(10) Patent No.: US 6,662,976 B2
(45) Date of Patent: Dec. 16, 2003

(54) DOSING SPOUT FOR MOUNTING ON A CONTAINER

(75) Inventors: Bjørn Slot Jensen, Køge (DK); Frank Lindberg, Greve (DK); Peter Lindberg, Greve (DK)

(73) Assignee: Lindberg & Jensen ApS, Roskilde (DK)

( * ) Notice: Subject to any disclaimer, the term of this patent is extended or adjusted under 35 U.S.C. 154(b) by 0 days.

(21) Appl. No.: 10/053,881

(22) Filed: Jan. 24, 2002

(65) Prior Publication Data

US 2002/0104854 A1 Aug. 8, 2002

(30) Foreign Application Priority Data

Jan. 24, 2001 (DK) ..... PA 2001 00124

(51) Int. Cl.[7] ..... B67D 3/00

(52) U.S. Cl. ..... 222/481.5; 222/504; 222/442; 222/641; 251/129.21

(58) Field of Search ..... 222/481, 481.5, 222/504, 509, 442, 640, 641, 129.1, 129.2, 129.3, 129.4, 63; 251/129.21

(56) References Cited

U.S. PATENT DOCUMENTS

| | | | | |
|---|---|---|---|---|
| 3,258,166 A | * | 6/1966 | Kuckens | 222/639 |
| 3,802,606 A | | 4/1974 | Gust | |
| 3,920,149 A | | 11/1975 | Fortino et al. | |
| 4,261,485 A | * | 4/1981 | Borg | 222/500 |
| 4,378,079 A | * | 3/1983 | Kuckens | 222/333 |
| 4,518,105 A | * | 5/1985 | Kuckens et al. | 222/207 |
| 4,598,845 A | | 7/1986 | Øzdemir | |
| 4,971,231 A | | 11/1990 | Faerber et al. | |
| 5,092,497 A | * | 3/1992 | Toedter | 222/434 |
| 5,133,482 A | * | 7/1992 | Burrows et al. | 222/185.1 |
| 5,603,430 A | | 2/1997 | Loehrke et al. | |
| 5,702,032 A | | 12/1997 | Loehrke | |
| 6,036,055 A | | 3/2000 | Mogadam et al. | |

FOREIGN PATENT DOCUMENTS

| | | |
|---|---|---|
| AT | 405276 | 6/1999 |
| DE | 4226580 | 2/1993 |
| DE | 9303504 | 7/1993 |
| DE | 200007148 | 7/2000 |
| DE | 20007149 | 8/2000 |
| JP | 11201306 | 7/1999 |

* cited by examiner

*Primary Examiner*—Gene Mancene
(74) *Attorney, Agent, or Firm*—Venable LLP; John P. Shannon

(57) ABSTRACT

A dosing spout for mounting on a container has a liquid outlet valve which, at placing of the spout in an electric field, can be actuated by the field for opening of outflow of liquid directly from the container and out through the mouth of the spout, and an air inlet valve which can let air from the surroundings directly into the container as compensation for the quantity of liquid flowing out. The armature of the liquid outlet valve and the armature of the air inlet valve are arranged consecutively in their longitudinal direction of displacement.

18 Claims, 7 Drawing Sheets

DOSING SPOUT FOR MOUNTING ON A CONTAINER

CROSS-REFERENCE TO RELATED APPLICATIONS

The present application claims the benefit of priority from Danish Patent Application No. PA 2001 00124 filed on 2001.

Statement Regarding Federally Sponsored Research Or Development

Not Applicable

Reference To A Microfiche Appendix

Not Applicable

BACKGROUND OF THE INVENTION

The present invention relates to a dosing spout for mounting on a container, said dosing spout having a liquid outlet valve, which, at placing of the spout in an electric field, can be actuated by the field for opening of outflow of liquid directly from the container and out through the mouth of the spout, and having an air inlet valve which can let air from the surroundings directly into the container as compensation for the quantity of liquid flowing out, the dosing spout being adapted for actuation of the liquid outlet valve and the air inlet valve for substantially simultaneous opening of these, and the liquid outlet valve and the air inlet valve being actuateable by displacement in the longitudinal direction of their respective, separate armatures, said armatures being influenced by the electric field.

U.S. Pat. No. 5,702,032 describes a dosing spout for mounting on a liquor bottle, where dosing takes place by opening of a valve for a pre-defined period of time corresponding to the quantity of liquor to be dispensed. At dispensing, the spout is passed into an electric coil which is energized, whereby the resulting electric field displaces an armature which is arranged in the spout and opens the valve. The quantity of liquor dispensed can thus be varied as required by control of the period of time in which the valve is open, for example, by means of a computer. The dosing spout is further provided with an air inlet in the form of a non-return valve placed inside the bottle at one end of a tube, the other end of which communicates with the surroundings. The non-return valve functions by means of a ball, which, in its closed position, is pressed against a seat by the liquid pressure in the bottle, and, during dispensing, is opened by the slight underpressure resulting from the outflow of liquid.

The prior-art dosing spout is not suitable for application, however, in connection with bottles that constantly hang upside down as in this situation the non-return valve will have difficulty in closing completely and it is therefore possible that liquor may leak out through the air inlet tube. If the non-return valve is designed with a closing force suitably large to enable it to close completely at a constant fluid pressure in the bottle, possibly by means of a spring, it will, however, find it difficult to open at the relatively small underpressure that occurs in the bottle during dispensing.

It has furthermore been established that in the prior-art devices the quantity of liquid dispensed cannot always be controlled suitably accurately in dependency of the period of time in which the valve is open.

AT 405276 describes a device for dispensing of beverages in portions, where a dispensing spout for mounting in a bottleneck comprises two magnetically actuateable valves for dispensing of liquid and air supply to the bottle, respectively. The valves can be actuated simultaneously by the field from an electromagnetic coil in which the dispensing spout is inserted at suspension of the bottle. The dispensing spout is divided into two longitudinal ducts extending in parallel, each containing a magnetically actuateable valve. Because of the two built-in valves the dispensing spout is relatively large, particularly in the transverse direction, and this means that the coil in which the spout is inserted at dispensing must have a rather large diameter. Furthermore this dispensing spout requires a rather strong magnetic field for the actuation, which necessitates an even larger coil that has a high cost price. As a consequence, particularly in case of dispensing systems having a large amount of bottles permanently suspended in their respective coils, this dispensing spout is unsuitable, because the large and consequently expensive coils raise the price of the equipment. In addition, the dispensing spout has a complex structure as it comprises many components, and consequently the device is also difficult to assemble during manufacturing.

In the catering trade it is often desired, however, that each bottle is provided with a dosing spout sealed onto the bottle to ensure registration of all dispensing. In this connection it is necessary to have a store of bottles fitted with dosing spouts, and therefore a simple and thus inexpensive structure is desired. In consideration of an agreeable design, emphasis is also on a structure of small dimensions.

BRIEF SUMMARY OF THE INVENTION

The object of the present invention is to devise a dosing spout which is simpler and more compact than prior-art devices.

In view of this, the dosing spout according to the invention is characterized in that the armature of the liquid outlet valve and the armature of the air inlet valve are arranged consecutively in the longitudinal direction.

By arranging the two displaceable armatures of the dosing spout consecutively in their direction of displacement, a much slimmer dosing spout can be achieved, which can thus be inserted in a coil with a substantially smaller inner diameter, so that the dimensions of the entire device are reduced considerably in relation to prior art. Furthermore, in this way the coil windings can be made to lie closely around the displaceable armatures, whereby the magnetic field is utilized better, so that less electric power has to be applied in the coil for actuation of the valves, and for that reason an even smaller coil can be applied. Moreover, this arrangement of the armatures makes it possible to design the liquid outlet valve and the air inlet valve integrally, thus saving components and space in relation to the prior-art structures.

In a particularly advantageous embodiment the armature of the liquid outlet valve and the armature of the air inlet valve are mutually displaceable by mutual magnetic influence as a result of the magnetic field. The stationary armatures of the valves can thus be omitted, allowing a particularly compact structure of the dosing spout as a whole. Furthermore, this prevents the container with dosing spout attached from being affected by an upward force at actuation, which can cause the container to jump out of the coil and fall to the floor.

Both armatures can be guided axially in a tubular spout section extending between a mounting portion for insertion in a neck of the container and the mouth of the spout, and, in the open position of the valves, both armatures can abut a fixed stop in the tubular spout section. This may ensure a suitable travel by both armatures at the opening of the valves.

In an advantageous embodiment in terms of design the armatures are guided by means of longitudinal ribs in the tubular spout section and the fixed stop may be in the form of projections on the ribs. In this way the liquid can pass the armatures and thus flow through the tubular spout section as it flows between the ribs, and this obviates the need for a separate duct for the liquid in the spout section. Also, by integrating the fixed stops with the ribs a simple design is achieved.

In an advantageous embodiment a magnetizable armature fixed stationarily in the dosing spout is placed between the armature of the liquid outlet valve and the armature of the air inlet valve. By placing the dosing spout in the associated coil so that the armature of the liquid outlet valve is fully or partly outside the coil and thus influenced less by the electric field from the coil, it is possible to cause opening of the air inlet valve for a fraction of a second, and preferably less than half a second, before opening of the liquid outlet valve, the current through and/or the voltage across the coil being increased step by step at dispensing. In this way, any underpressure in the container can be eliminated by influx of air through the air inlet valve before the dispensing of liquid, and this prevents air from being sucked in through the mouth of the liquid outlet valve instead, which would cause dispensing of a smaller quantity of liquid than intended at the subsequent dispensing operation. Underpressure may, for example, occur if a bottle has been stored in a warm storage room and is subsequently put to use in a colder room.

Each of the displaceable armatures may have a central bore for reception of respective ends of a compression spring, one of the armatures may have two sections with different diameters so that a shoulder is formed between the sections, and the section with the smaller diameter can be designed so that it can pass between the projections on the ribs and that the shoulder can thereby abut the projections. This allows a more compact structure, as the armatures can be designed so that, at opening of the valves, they move so close to each other that they nearly touch. Furthermore, the guidance of the spring is good in the central bores.

In an advantageous embodiment the air inlet valve is actuated by the armature located furthest away from the mouth of the spout, and the tubular spout section is separated from the seat of the air inlet valve by means of a membrane. By means of the membrane the air inlet valve can, in a simple and functional way, be separated from its armature in the tubular spout section, through which liquid can flow. As the air inlet valve is opposite to the mouth of the spout, the membrane and the air inlet valve can be arranged outside the tubular spout section, where there is more space for these components and the associated air ducts.

In a particularly simple embodiment the membrane is formed integrally with a valve body, which abuts the seat of the air inlet valve upon closure thereof. Membrane and valve body can thus be made of the same material, for example rubber, as the membrane part can be thin and the valve body can be relatively thick. This obviates a component as well as design of connecting members between the membrane and the valve body. In addition, assembly becomes easier as one assembly operation is left out.

The armature of the air inlet valve can advantageously be permanently connected with the central part of the membrane forming the valve body. The valve body can thus be guided by the armature and can, by the armature, be pulled away from its seat at opening of the valve.

In an advantageous embodiment the air inlet valve is placed at one end of a duct, the other end of which, through a non-return valve, opens inside the container when the dosing spout is mounted thereon. This prevents liquid from flowing out through the air inlet valve at the opening thereof during dispensing, due to, for example, overpressure in the container due to heating. It is further an advantage that the valve body of the air inlet valve and the valve seat are kept separate from the liquid in the container and are thus only in contact with air, which enables the valve to function more accurately.

The non-return valve can preferably be arranged right by the neck of the container. In this way the non-return valve is surrounded by liquid from when the container is full until it is almost empty, which ensures more consistent functioning of the non-return valve and thus a more uniform outflow of liquid through the spout. This is a substantial advantage as the quantity of liquid dispensed in a predefined period of time will be largely independent of whether the bottle is full or nearly empty, and a specified quantity of liquid can therefore be dispensed with good accuracy merely by control of the period of time in which the liquid outlet valve is open. Furthermore this prevents the non-return valve from going dry thus causing the valve body to stick to the seat, which can occur particularly in the case of, for example, sugar-containing liquids.

In an alternative embodiment the air inlet valve is placed at one end of an elongated duct, the other end of which opens inside the container. In this way, a certain quantity of liquid can be received in the duct before the liquid reaches the air inlet valve and flows out through said valve. The risk of outflow is thus minimized.

The duct may preferably have a length which is at least three times longer than the inner diameter of the container neck in which the mounting portion is to be inserted. This provides a more uniform flow rate out through the spout, from when the container is full until it is empty, which is an advantage as mentioned above.

The present invention further relates to a dosing spout and an electric coil in which the dosing spout can be inserted axially, the dosing spout and the coil being adapted so that the dosing spout can lean against the coil in a position where the air inlet valve can be caused to open by application of less power in the coil than required for opening of the liquid outlet valve. In this way the advantages mentioned above are achieved.

In an advantageous manner the armature of the liquid outlet valve is located fully or partly outside the windings of the coil when the dosing spout leans against the coil. More power is thus required in the coil for opening the liquid outlet valve than for opening the air inlet valve.

Alternatively the armature of the liquid outlet valve may have a smaller mass and/or diameter than the armature of the air inlet valve, whereby it is possible in the same way to open the air inlet valve shortly before the liquid outlet valve.

Finally the function just described can be achieved by the armature of the liquid outlet valve being preloaded in the closed position of the liquid outlet valve with a larger spring force than the armature of the air inlet valve in the closed position of the air inlet valve.

The present invention further relates to a system for dispensing of liquor or the like, comprising a bottle holder with an electromagnetic coil and a dosing spout for insertion in the coil, as well as a data processing unit for control of the magnetic field of the coil for dispensing of predefined quantities of liquid and for registration of the number of drinks dispensed.

The system may be adapted for control of the magnetic field of the coil so that, at dispensing, the field first assumes a low value for a fraction of a second, preferably less than half a second, and then assumes a higher value.

The present invention also relates to a method of dispensing of liquor Or the like, according to which the dosing spout described above is inserted in an electric coil and the coil is subsequently energized for application of a first power input in the coil for a fraction of a second, preferably less than half a second, whereby the air inlet valve of the dosing spout is opened, whereupon the current and/or voltage of the coil is increased for application of a second power input which is larger than the first power input, whereby the liquid outlet valve of the dosing spout is opened.

BRIEF DESCRIPTION OF THE SEVERAL VIEWS OF THE DRAWING

The invention will now be described in more detail below by means of examples of embodiments with reference to the very schematic drawing, in which.

DETAILED DESCRIPTION OF THE INVENTION

Figure 1:
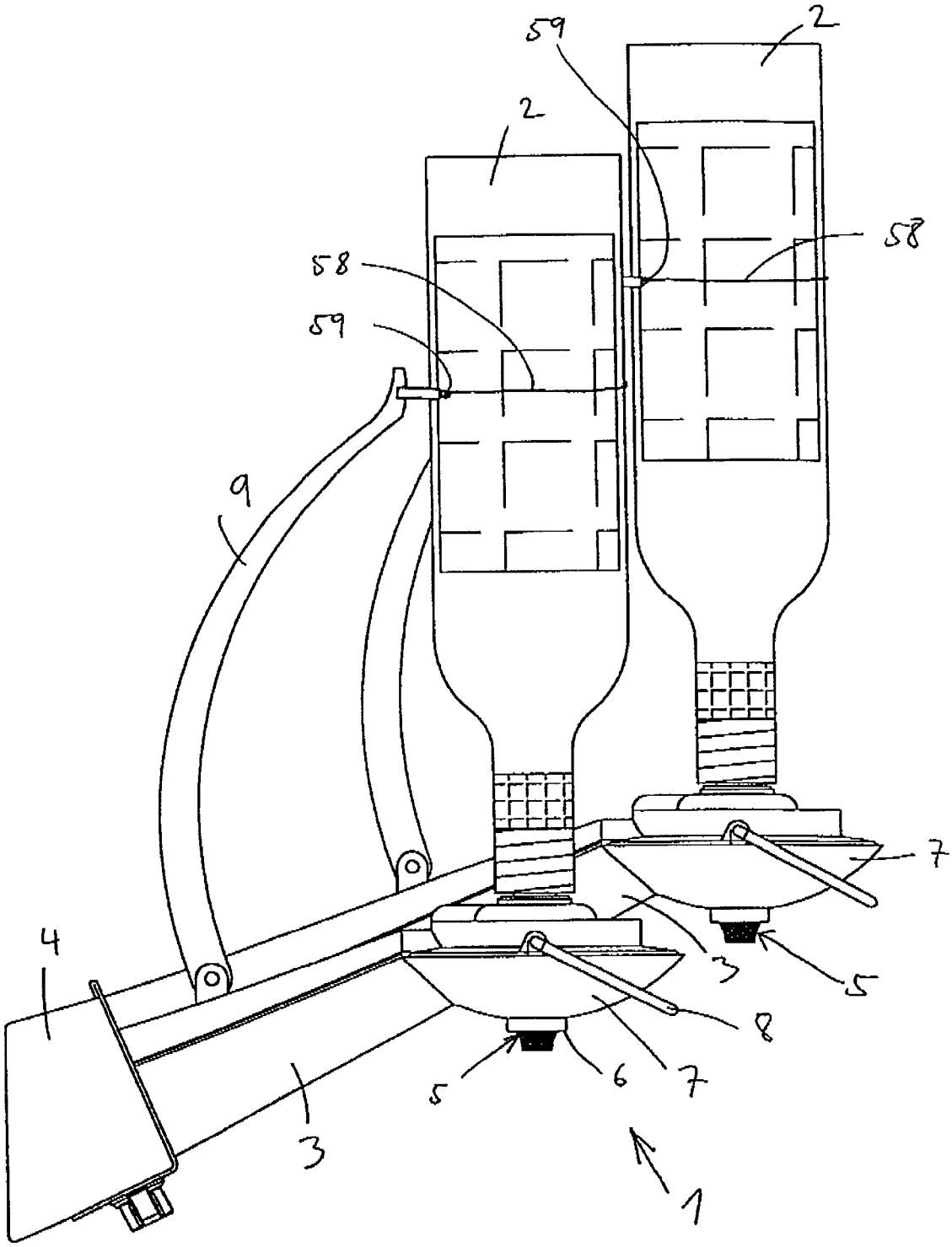
FIG. 1 shows a system for dispensing from bottles that are hung upside down and where a dosing spout according to the invention is inserted in each bottle.

FIG. 1 shows a dispensing system 1, where several liquor bottles 2 are hung upside down in respective arms 3 projecting obliquely upwards from a base board 4. In the bottleneck of each bottle 2 a dosing spout 5 is inserted, whose portion projecting from the bottle is inserted in a vertically extending aperture 6 in a bottle holder 7 mounted at the end of the arm 3. The dosing spout 5 may be sealed onto the bottle with a band, not shown. At dispensing, a glass is held under the dosing spout 5, and dispensing is actuated by pressing a bow 8 suspended swingably in the bottle holder and actuating an electric switch, not shown, that connects the current to an electromagnetic coil 42 which in the bottle holder is wound around the vertically extending aperture 6. The bottles 2 may be of different sizes and are supported by a supporting arm 9 mounted swingably on the arm 3. The bottles 2 may further be held against the supporting arm 9 by means of an elastic string 58 attached at either end to a hook 59 on the supporting arm 9. The dosing spout 5 according to the invention is not only suitable for dispensing of liquor, but can advantageously be applied for many different purposes where accurate dispensing of liquid from a container is desired.

Figure 2:
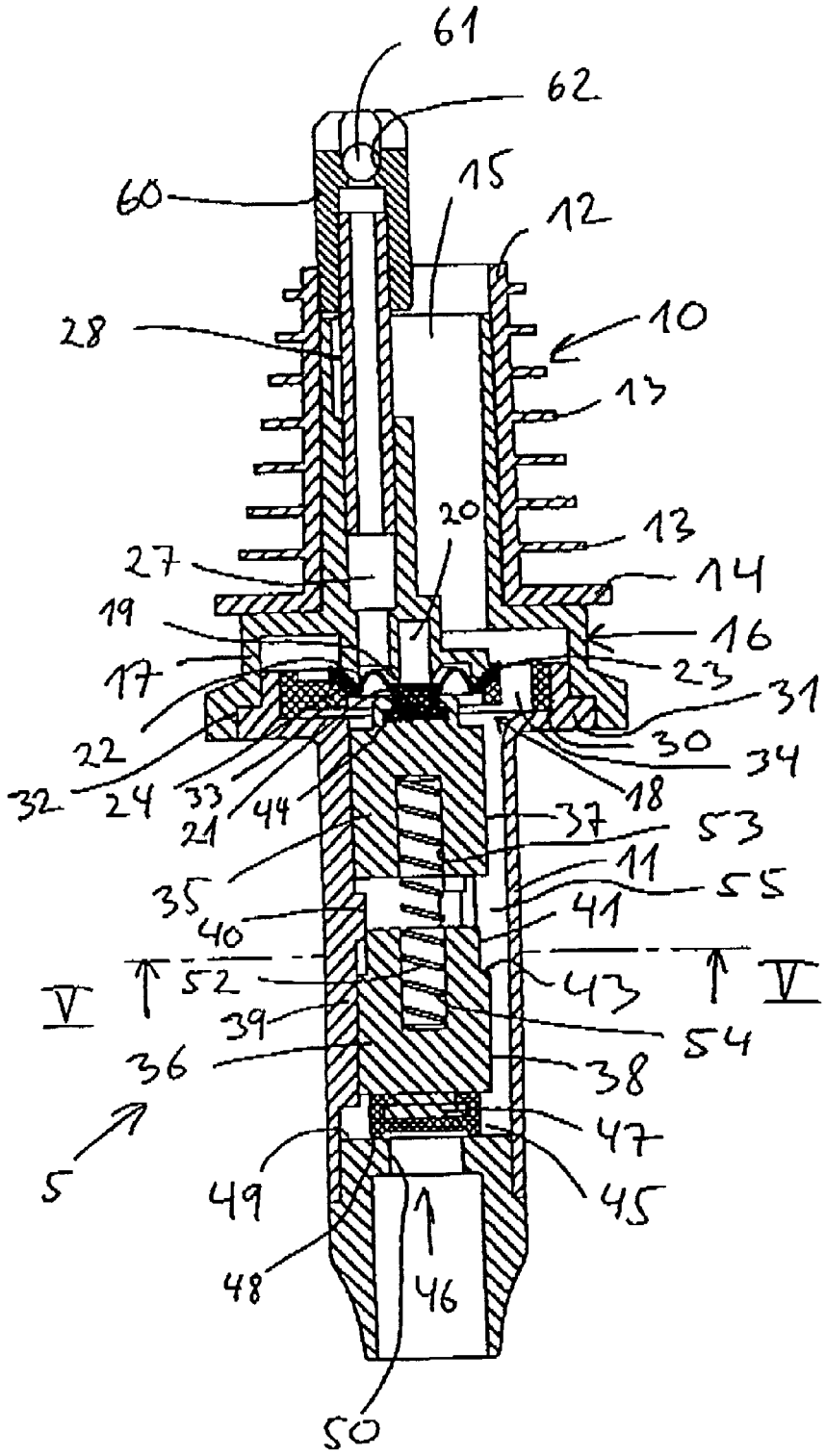
FIG. 2 is an axial section through a dosing spout according to the invention, the spout being closed for outflow of liquid.

FIG. 2 is an axial section of the dosing spout 5, the bottle 2 being left out. The dosing spout S comprises an upper tubular mounting portion 10 adapted for insertion in the bottleneck, and in extension of the mounting portion 10 an also tubular valve housing 11 which in the mounted position of the dosing spout in the bottleneck projects therefrom. The mounting portion 10 is formed as a tube 12 with a slightly tapering diameter in the upward direction, i.e., in the inward direction in the bottleneck when the dosing spout is mounted therein, and on the outer surface of the tube 12 a number of circumferential, elastic flaps 13 are formed which are spaced along the axial direction of the tube 12 and the diameters of which also decrease in the direction into the bottleneck. The circumferential flaps 13 have a larger diameter than the inner diameter of the bottleneck and at insertion of the mounting portion 10 in the bottleneck, the flaps 13 deform and retain the mounting portion 10 in the bottleneck by friction, the flaps 13 also sealing the mounting portion 10 in relation to the bottleneck. At the lower edge of the tube 12 a circumferential stop 14 is formed, the upper edge of which the bottleneck can abut.

Figure 4:
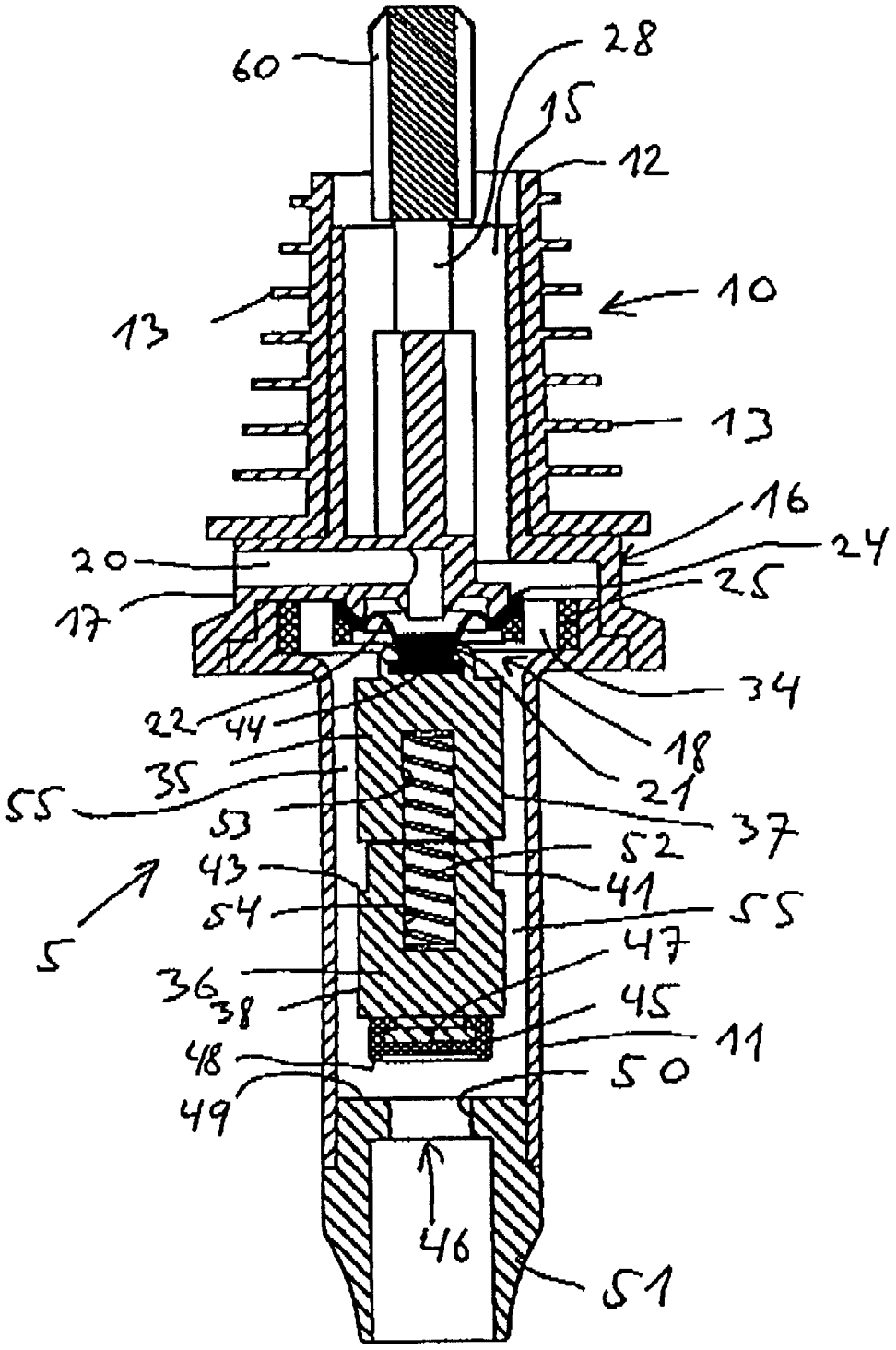
FIG. 4 is an axial section through the spout in a plane perpendicular to the sectional plane of FIG. 2, in the open position.

In the tube 12 of the mounting portion 10, an also tubular portion 15 of an intermediate section 16 is inserted in a sealing manner. In extension of and below the tubular portion 15, the intermediate section 16 has a cylindrical portion 17 having a larger outer diameter than the inner diameter of the bottleneck and forming a valve housing for an air inlet valve 18. Centrally in the cylindrical portion 17 a valve seat 19 facing downwards is formed and constitutes a mouth for an air inlet duct 20 passed sidewards out through the cylindrical portion 17 so that it connects the valve seat 19 with the surrounding air, see FIG. 4. FIG. 2 shows the air inlet valve 18 in its closed position, a valve body 21 being pressed against the valve seat 19. The valve body 21 is formed as a cylindrical rubber body, which is axially displaceable away from the valve seat 19 as it is fastened centrally in a circular, elastic membrane 22 having a peripheral circumferential edge 23 with increased material thickness, which is fastened between a circumferential abutment surface 24 facing downwards in the cylindrical portion 17 and a circumferential abutment surface 26 facing upwards on a membrane holder 25, see FIG. 7. The air valve body 21 and the membrane 22 are formed integrally, for example of silicone.

Figure 3:
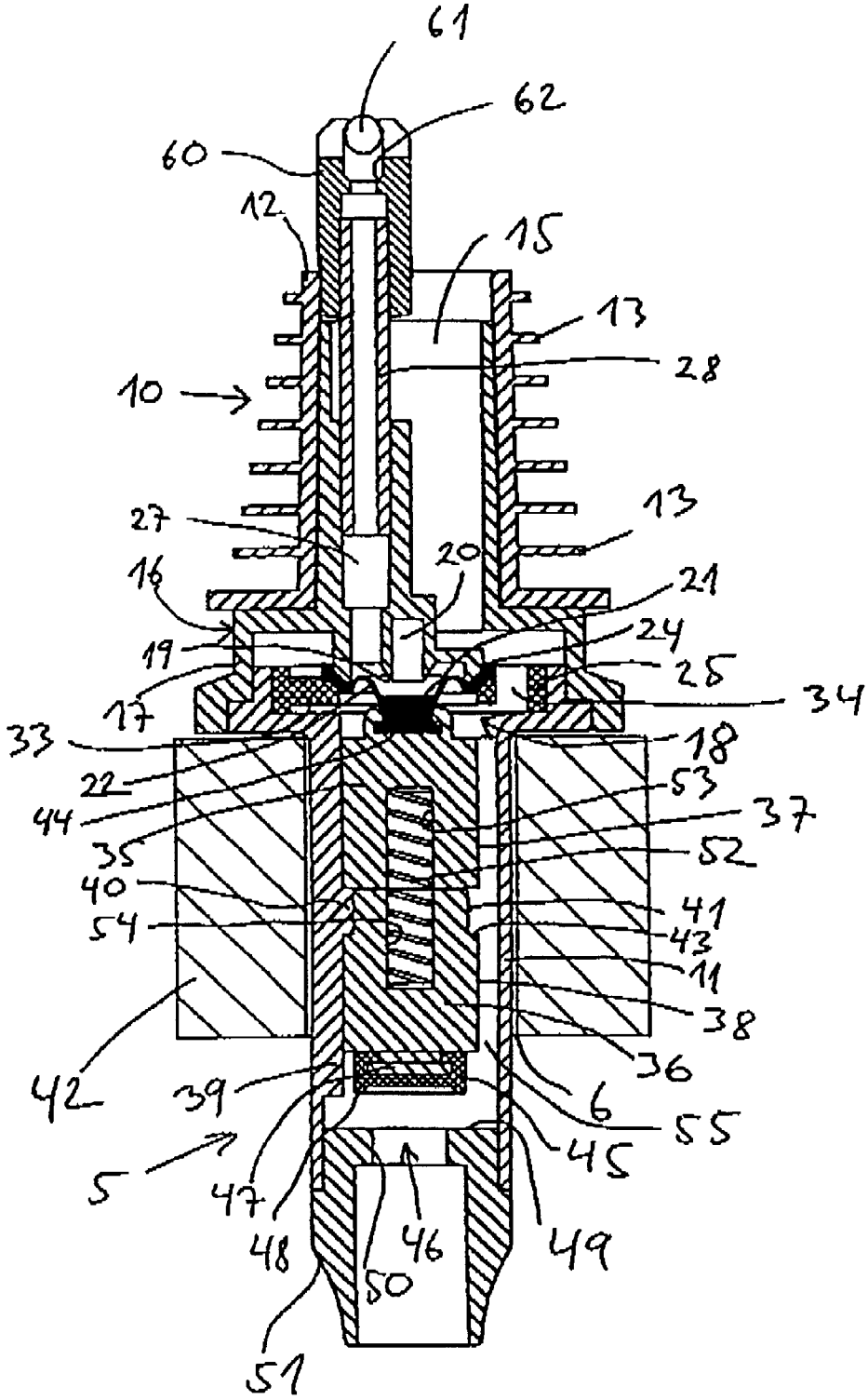
FIG. 3 is an axial section corresponding to FIG. 2, but where the spout is inserted in an electromagnetic coil and open for outflow of liquid.

Between the air valve seat 19 and the circumferential abutment surface 24 facing downward located around said air valve seat, connection is established in the open position of the air inlet valve 18 shown in FIG. 3 between the air inlet duct 20 and an air inlet passage 27 extending upward in the intermediate section 16, in which air inlet passage 27 a lower end of an air tube 28 is inserted, whose upper end is connected with the entry side of a non-return valve 60 arranged at the upper edge of the mounting portion 10, and so that the exit side thereof in the mounted position of the dosing spout opens into the bottle at the neck thereof. The non-return valve 60 is of a type commonly known with a ball 61 that can abut a seat 62 so that it prevents liquid from flowing from the bottle down into the air tube 28, but so that air can flow from the air tube 28 up into the bottle. This prevents liquid from flowing out through the air inlet duct 20 due to overpressure in the bottle at opening of the air inlet valve 18. Other types of non-return valves may also be applied.

Figure 7:
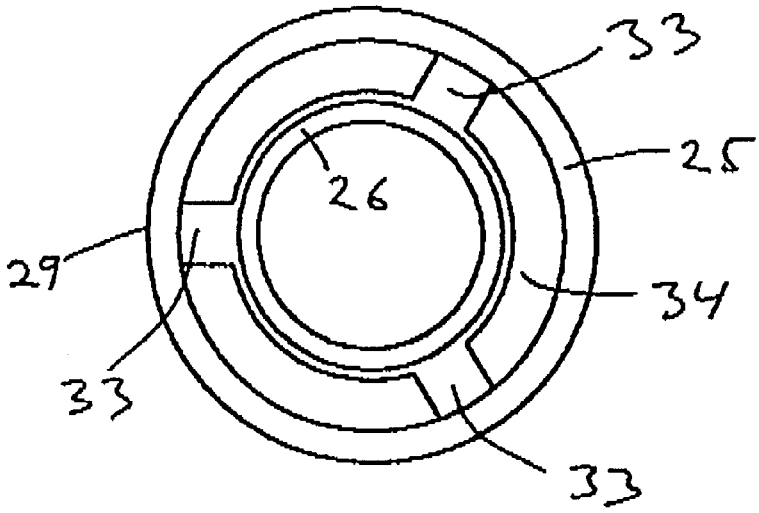
FIG. 7 is a top view of the membrane holder for the air inlet valve.

The membrane holder 25 shown in FIG. 7 has a peripheral cylinder surface 29 mounted in a cylindrical bore 30 in an upper circumferential flange 31 of the lower valve housing 11. The flange 31 is inserted sealingly in a lower stepped bore 32 in the intermediate section 17 so that the circumferential abutment surface 26 on the membrane holder 25 presses the membrane 22 firmly up against the circumferential abutment surface 24 formed in the cylindrical portion 17 The membrane 22 thus separates the air valve seat 19 sealingly from the liquid passage in the valve housing 11. As it appears from FIG. 7 the circumferential abutment surface 26 on the membrane holder 25 is connected with the outer peripheral cylinder surface 29 of the membrane holder by means of three ribs 33 spaced in the circumferential direction of the membrane holder 25 so as to create through holes 34 for liquid.

Inside the tubular valve housing 11 two armatures 35, 36 are mounted axially displaceably in extension of each other. Each armature 35, 36 has an outer cylinder surface 37, 38 which can slide on three longitudinal ribs 39 protruding radially inwards and formed in the tubular valve housing 11. Approximately at the middle of each rib 39 in its longitudinal direction a projection 40 is formed of such extent in the radial direction of the valve housing 11 that an upper section 41 with a reduced diameter on the lower armature 36 can only just pass the projections 40. The turned-down section 41 on the lower armature 36 has the same extent in the longitudinal direction of the valve housing as the projection 40 so that, at insertion of the valve housing 11 in a current-carrying electromagnetic coil 42 in the bottle holder 7, the armatures 35, 36 can be axially displaced so much towards each other by mutual magnetic attraction that they nearly touch, as shown in FIG. 3. The projections 40 thus form a stop for the lower surface of the upper armature 35 and a shoulder 43 between the turned-down section 41 and the outer cylinder surface 38 on the lower armature 36, respectively, which prevents one of the armatures, at the magnetic attraction, from moving considerably further than the other, whereby, for example, the membrane 22 might be damaged.

At its upper surface, the upper armature 35 is connected with the lower surface of the valve body 21 for the air inlet valve 18, the elastic valve body 21 being sealingly pressed into a bore 44 with a lower section of increased diameter in the upper surface of the upper armature 35. When the upper armature 35 is actuated by the electromagnetic field, the armature thus pulls the valve body 21 downwards and away from the valve seat 19 by deformation of the elastic membrane 22, so that connection is established from the surrounding air through the air inlet duct 20, the valve seat 19, the air inlet passage 27, the air tube 28 and the non-return valve 60 into the bottle 2, so that, at outflow of liquid from the bottle, air can be sucked into said bottle to replace the quantity of liquid flowing out. The downward movement of the upper armature 35 is thus stopped by the projections 40, which prevents overloading of the membrane 22.

At its lower surface, the lower armature 36 is provided with a valve body 45 for a liquid outlet valve 46. The valve body 45 is made of an elastic material and fastened to the lower surface of the armature 36 by sealingly pressing around a downward projection 47 from the armature 36, which projection has a lower section with an increased diameter. At its lower surface the valve body 45 has a peripheral rim 48 projecting downwards that can sealingly abut a valve seat 49 of the liquid outlet valve 46, see FIG. 2. The valve seat 49 consists of an upward circumferential surface located around an axial through hole 50 in a nozzle 51 for the dosing spout 5, which nozzle is inserted at the bottom of the tubular valve housing 11. The air inlet valve 18 and the liquid outlet valve 46 might also be opened and closed by a shared armature moving both valve bodies 21, 45, one or both valve bodies being connected with the armature via a suitably elastic connection for absorption of inaccuracies between the positions of the two valve seats in relation to each other. One of the valve seats could then possibly face in the opposite direction in relation to the one shown, so that both valve bodies had to be displaced in the same direction to close the valves.

Figure 6:
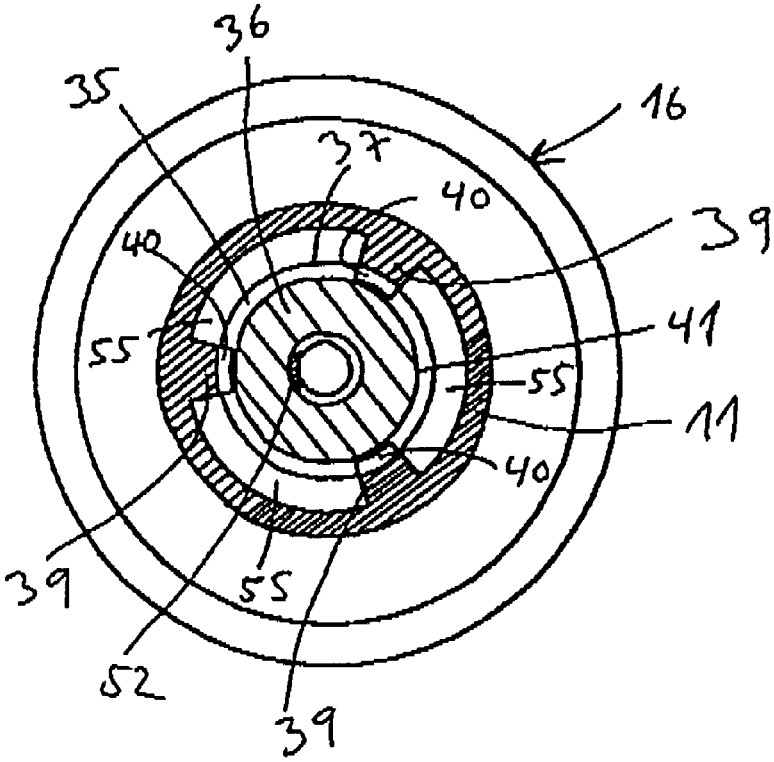
FIG. 6 is a sectional view along the line V—V in FIG. 2.

In the closed position of the dosing spout 5 shown in FIG. 2, the two armatures 35, 36 are pressed away from each other by a compression spring 52 mounted between the armatures, the upper end of the spring 52 abutting the bottom of a coaxial aperture 53 in the armature 35, and the lower end of the spring 52 similarly abutting the bottom of a coaxial aperture 54 in the lower armature 36. In the open position of the dosing spout 5 shown in FIG. 3, the compression spring 52 is thus received completely in the apertures 53, 54 in the armatures 35, 36, respectively. In the open position liquid can flow from the inside of the bottle through the tubular portion 15 of the intermediate section 16, whereupon the liquid can pass the through holes 34 in the membrane holder 25 and thus pass down into the tubular valve housing 11. In the valve housing 11 the liquid can pass the armatures 35, 36, as it flows through passages 55 defined by the armatures 35, 36, the inner surface of the valve housing 11 and the ribs 39 projecting radially inwards in the housing, see FIG. 6. When the liquid has passed the armatures 35, 36, it can flow out through the aperture 50 in the valve seat 49 of the liquid outlet valve 46 and then leave the dosing spout 5 through the mouth of the nozzle 51. The armatures may advantageously be made of stainless magnetic steel, for example 2002, so that contact with foods is unproblematic. Alternatively, the armatures 35, 36 can be encased in plastic. The other parts of the dosing spout 5 may advantageously be made of plastic, for example of the type ABS, which is approved for use in connection with foods. The compression spring 52 may be of stainless spring steel.

Figure 5:
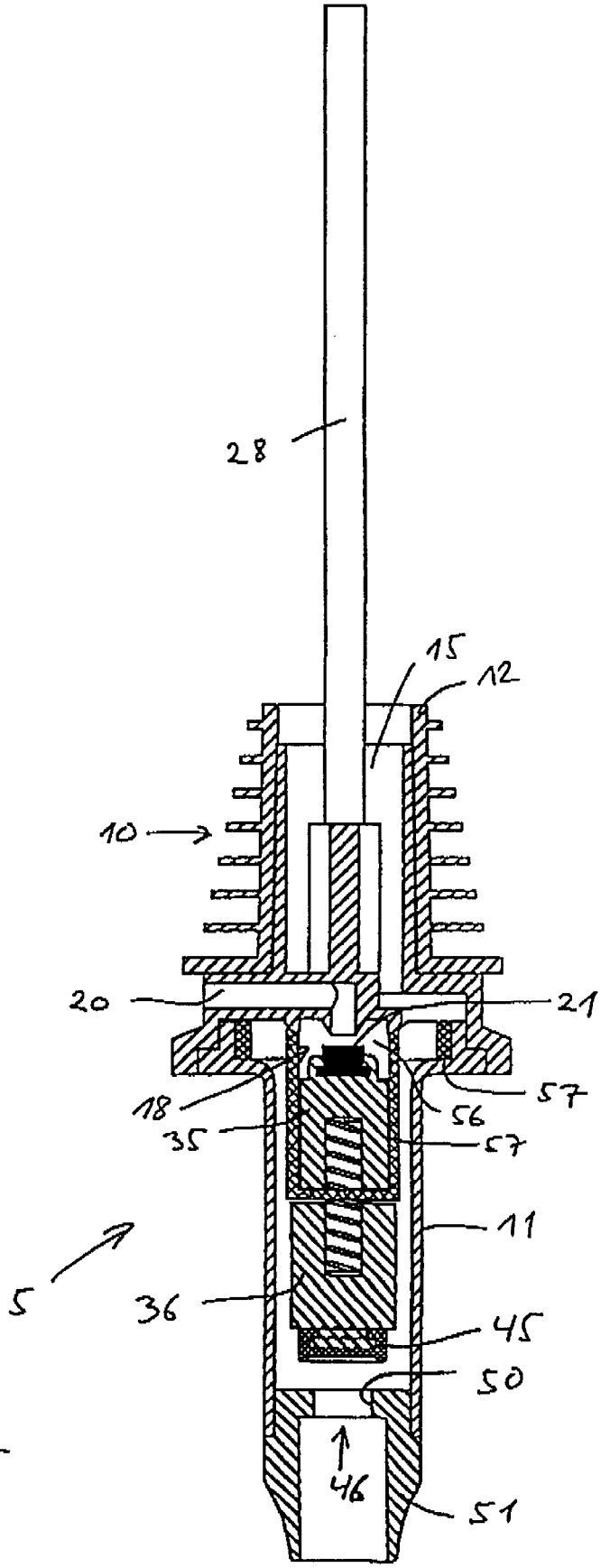
FIG. 5 is an axial section corresponding to FIG. 4 of another embodiment of the dosing spout.

FIG. 5 shows another embodiment of the dosing spout 5, in which the armature 35 that moves the air inlet valve 18 is located in a chamber 56 which is separated from the liquid passage in the valve housing 11, so that the membrane 22 is not required. In this embodiment, the membrane holder 25 is replaced by a separate valve housing 57 for the air inlet valve 18. Furthermore, the non-return valve 60 is replaced by a longer air tube 28 which, in the mounted position of the dosing spout in the bottle, projects into said bottle by about a third of the total length of the bottle, for example about 90 mm. The relatively long and thin air tube 28 prevents liquid from getting into contact with the air inlet valve 18, as the liquid may possibly go only slightly down into the tube between dispensing operations, whereupon it will be displaced into the bottle again by the air flowing in.

When the dosing spout 5 is inserted in the coil 42, and said coil is energized, both armatures 35, 36 are actuated simultaneously, whereby the air inlet valve 18 and the liquid outlet valve 46 open substantially simultaneously. Due to this, the quantity of liquid flowing out can immediately, upon the opening of the liquid outlet valve 46, be replaced by air flowing in through the air inlet valve 18, which is an advantage since the outflow thus takes place evenly immediately from opening to closing of the dosing spout 5. This well-defined, uniform outflow ensures that, within a given time interval, a well-defined quantity of liquid will flow out. Consequently, it is possible to dispense very accurate quantities of liquid at each dispensing operation, which, for example at dispensing of alcoholic beverages, ensures that the customer gets the correct quantity, while no more than what is paid for is dispensed.

With the dosing spout described above with two armatures moving by mutual attraction, the air inlet valve and the liquid outlet valve usually open largely simultaneously, as mentioned, which is advantageous in consideration of the dosing, but for various reasons, the liquid outlet valve may open a fraction of a second sooner than the air inlet valve, which may cause any underpressure in the bottle to cause air to be sucked in through the liquid outlet valve at the opening. The liquid present in the liquid passages of the dosing spout will thus be fully or partly replaced by air, and subsequently a smaller quantity of liquid than usual will be dispensed. This can be avoided by means of the embodiment described below.

Figure 8:
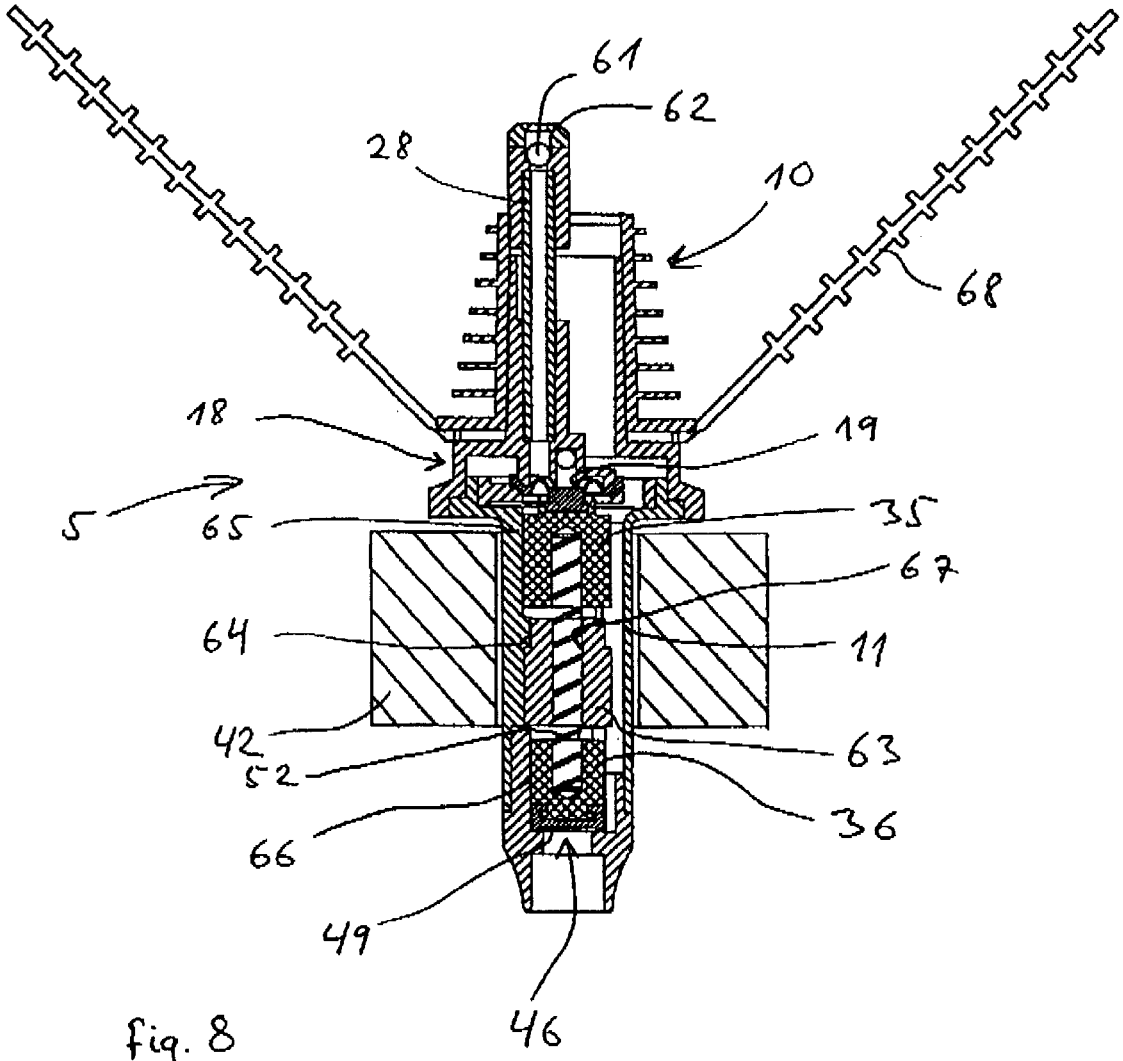
FIG. 8 is an axial section corresponding to FIG. 2 of another embodiment of the dosing spout.

FIG. 8 shows another embodiment of the dosing spout 5 according to the invention, in which, between the displaceable armatures 35, 36 of the air inlet valve 18 and the liquid outlet valve 46, respectively, an armature 63 of a magnetizable material is fixed in the tubular spout section 11, so that the armature 63 is stationary in relation to the spout section 11. The stationary armature 63 forms a stop for the displaceable armatures 35, 36, so that projections on the longitudinal ribs can be left out. However, the stationary armature 63 is retained in the spout section 11 at its upper end by projections 64 on guiding ribs 65 for the armature 35 of the air inlet valve and at its lower end by ends of guiding ribs 66 for the armature 36 of the liquid outlet valve. Like in the embodiment shown in FIG. 2, the displaceable armatures 35, 36 are preloaded away from each other towards their seats 19, 49 by means of a compression spring 52 extending here through a bore 67 in the stationary armature 63, but the spring 52 may also be divided into two springs abutting respective sides of the stationary armature 63.

The dosing spout 5 shown in FIG. 8 is inserted in a coil 42, leaning against it so that the armature 36 of the liquid outlet valve is located below the coil 42, but so that the armature 35 of the air inlet valve is located almost entirely inside the coil 42, and the stationary armature 63 is located inside the coil 42. In this way, the armature 35 of the air inlet valve is influenced more by a given electric field from the coil 42 than is the case for the armature 36 of the liquid outlet valve. The latter armature 36 further has a slightly smaller outer diameter than the armature 35, so that it is positioned further away from the coil 42 and its mass is furthermore a little smaller than the mass of the armature 35, and both of these conditions contribute to the effect mentioned of the field from the coil 42.

At dosing of liquid, voltage is applied to the coil 42 so that it forms an electric field just capable of opening the air inlet valve 18, whereby any underpressure in the bottle 2 is eliminated by suction of air in through the air inlet valve 18, and a traction of a second thereafter, the voltage or current is increased so that the field becomes sufficiently strong to open the liquid outlet valve 46. This prevents suction of air in through the liquid outlet valve at the opening thereof.

If the compression spring 52 is divided into two separate springs, as mentioned above, the delay in time described between the opening of the valves 18, 46 can also be achieved by letting the spring for the air inlet valve 18 have a smaller closing force than the spring for the liquid outlet valve 46. The effect can also be achieved with a coil with more windings at its upper end, or possibly by means of a coil with a central outlet. The effect can furthermore be achieved by a combination of one or more of the means described.

The delay in time between the opening of the valves 18, 46 may possibly be effected at only the first putting into operation after mounting a bottle in the system, so that the air inlet valve 18 and liquid outlet valve 46 at subsequent dispensing operations opens so accurately simultaneously as possible. The problem of underpressure in the bottle often occurs only the first time dispensing from it, and then advantageously the delay may be let out subsequently. Likewise, it will be possible by means of a temperature sensor to detect temperature changes in the room, so that the delay can happen automatically when this may he necessary. In certain cases the delay may then possibly be up to around a second. In this way, the response time at most dispensing operations may be very short, at the same time ensuring sufficient dosing in all cases.

The serrated bands 68 shown in FIG. 8 serve to seal the dosing spout S onto a bottle 2.

The dosing spout 5 according to the invention can be designed in other ways than the ones shown without falling outside the scope of the invention; the membrane 22 may, for example, be replaced by a different type of sealing, such as slide sealing, or the valve bodies 21, 45 may be designed differently. In case of a suitable design of the armatures 35, 36, the compression spring 52 might also be arranged around the armatures instead of in the central bores 53, 54 in the armatures. The embodiments shown can be combined in different ways; the non-return valve 60 in the embodiment shown in FIG. 2 may, for example, be replaced by the long air tube 28 shown in FIG. 5, and vice versa.

What is claimed is:

1. A dosing spout for mounting on a container comprising: a liquid outlet valve which, at placing of the spout in an electric field, can be actuated by the field for opening of outflow of liquid directly from the container and out through a mouth of the spout, and an air inlet valve which can let air from the surroundings directly into the container as compensation for a quantity of liquid flowing out, the dosing spout being adapted for actuation of the liquid outlet valve and the air inlet valve for substantially simultaneous opening of these, the liquid outlet valve and the air inlet valve each having a separate armature and each being actuateable by displacement in longitudinal direction of its respective armature, said armatures being influenced by the electric field, and the armature of the liquid outlet valve and the armature of the air inlet valve being arranged consecutively in the longitudinal direction.

2. A dosing spout according to claim 1, wherein the armature of the liquid outlet valve and the armature of the air inlet valve are mutually displaceable by mutual magnetic influence as a result of the magnetic field.

3. A dosing spout according to claim 1, wherein both armatures are guided axially in a tubular spout section by means of longitudinal ribs in the latter, the tubular spout section extends between a mounting portion for insertion in a neck of the container and the mouth of the spout, and, in the open position of the valves, both armatures abut a fixed stop in the tubular spout section.

4. A dosing spout according to claim 1, wherein a magnetizable armature fixed stationarily in the dosing spout is placed between the armature of the liquid outlet valve and the armature of the air inlet valve.

5. A dosing spout according to claim 1, wherein each displaceable armature has a central bore for reception of respective ends of a compression spring.

6. A dosing spout according to claim 1, wherein one of the displaceable armatures has two sections with different diameters so that a shoulder is formed between the sections, the section with the smaller diameter can pass between projections on the ribs, and the shoulder can thereby abut the projections.

7. A dosing spout according to claim 3, wherein the air inlet valve is actuated by the armature located furthest away from the mouth of the spout, and the tubular spout section is separated from the seat of the air inlet valve by means of a membrane formed integrally with a valve body, which abut the seat of the air inlet valve upon closure thereof.

8. A dosing spout according to claim 1, wherein the air inlet valve is placed at one end of a duct, the other end of which, through a non-return valve, opens inside the container when the dosing spout is mounted thereon, and the non-return valve is preferably arranged right by the neck of the container.

9. A system for dispensing of liquor comprising: a bottle holder with an electromagnetic coil and a dosing spout according to claim 1 for insertion in the coil, as well as a data processing unit for control of the magnetic field of the coil for dispensing of predefined quantities of liquid and for registration of the number of drinks dispensed.

10. A dosing spout for mounting on a container comprising: a liquid outlet valve which, at placing of the spout in an electric field, can be actuated by the field for opening of outflow of liquid directly from the container and out through a mouth of the spout, and an air inlet valve which can let air from the surroundings directly into the container as compensation for a quantity of liquid flowing out, the liquid outlet valve and the air inlet valve each having a separate armature and each being actuateable by displacement of its respective armature, said armatures being influenced by the electric field, and the spout being provided with a magnetizable armature fixed stationarily in the dosing spout and being placed between the armature of the liquid outlet valve and the armature of the air inlet valve.

11. A dosing spout according to claim 10, and an electric coil in which the dosing spout can be inserted axially, wherein the dosing spout and the coil are adapted so that the dosing spout can lean against the coil in a position where the air inlet valve can be caused to open by application of less power in the coil than required for opening of the liquid outlet valve.

12. A dosing spout according to claim 11, wherein the armature of the liquid outlet valve is located fully or partly outside the windings of the coil when the dosing spout leans against the coil.

13. A dosing spout according to claim 11, wherein the armature of the liquid outlet valve has a smaller mass than the armature of the air inlet valve.

14. A dosing spout according to claim 11, wherein the armature of the liquid outlet valve has a smaller diameter than the armature of the air inlet valve.

15. A dosing spout according to claim 11, wherein the armature of the liquid outlet valve is preloaded in the closed position of the liquid outlet valve with a larger spring force than the armature of the air inlet valve in the closed position of the air inlet valve.

16. A system for dispensing of liquor comprising: a bottle holder with an electromagnetic coil and a dosing spout according to claim 10 for insertion in the coil, as well as a data processing unit for control of the magnetic field of the coil for dispensing of predefined quantities of liquid and for registration of the number of drinks dispensed, the system being adapted for control of the magnetic field of the coil so that, at dispensing, the field first assumes a low value for a fraction of a second, preferably less than half a second, and then assumes a higher value.

17. A dosing spout for mounting on a container comprising: a liquid outlet valve which, at placing of the spout in an electric field, can be actuated by the field for opening of outflow of liquid directly from the container and out through a mouth of the spout, and an air inlet valve which can let air from the surroundings directly into the container as compensation for a quantity of liquid flowing out, the liquid outlet valve and the air inlet valve each having a separate armature and each being actuateable by displacement of its respective armature, said armatures being influenced by the electric field, and the armature of the liquid outlet valve and the armature of the air inlet valve being mutually displaceable by mutual magnetic influence as a result of the magnetic field.

18. A method of dispensing of liquor wherein:

a dosing spout is inserted in an electric coil;

the dosing spout comprising a liquid outlet valve which, at placing of the spout in an electric field, can be actuated by the field for opening of outflow of liquid directly from the container and out through a mouth of the spout, and an air inlet valve which can let air from the surroundings directly into the container as compensation for a quantity of liquid flowing out, the liquid outlet valve and the air inlet valve each having a separate armature and each being actuateable by displacement of its respective armature, said armatures being influenced by the electric field;

and the coil is subsequently energized for application of a first power input in the coil for a fraction of a second, preferably less than half a second, whereby the air inlet valve of the dosing spout is opened, whereupon the current and/or voltage of the coil is increased for application of a second power input which is larger than the first power input, whereby the liquid outlet valve of the dosing spout is opened.

* * * * *